US009921542B2

(12) United States Patent
Mochizuki et al.

(10) Patent No.: US 9,921,542 B2
(45) Date of Patent: Mar. 20, 2018

(54) IMAGE FORMING APPARATUS FOR FORMING IMAGE USING DEVELOPER, METHOD FOR REGULATING ATTACHMENT/DETACHMENT OF DEVELOPER STORAGE PORTION

(71) Applicant: KYOCERA Document Solutions Inc., Osaka-shi, Osaka (JP)

(72) Inventors: Masayuki Mochizuki, Osaka (JP); Tsuyoshi Terada, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/496,992

(22) Filed: Apr. 25, 2017

(65) Prior Publication Data

US 2017/0315502 A1 Nov. 2, 2017

(30) Foreign Application Priority Data

Apr. 28, 2016 (JP) ..... 2016-091138

(51) Int. Cl.

| | |
|---|---|
| ***G03G 21/16*** | (2006.01) |
| ***G03G 21/10*** | (2006.01) |
| ***G03G 21/12*** | (2006.01) |
| ***G03G 15/08*** | (2006.01) |

(52) U.S. Cl.

CPC ..... *G03G 21/1676* (2013.01); *G03G 15/0891* (2013.01); *G03G 21/105* (2013.01); *G03G 21/12* (2013.01)

(58) Field of Classification Search

CPC .. G03G 15/0891; G03G 21/105; G03G 21/12; G03G 21/1676

See application file for complete search history.

(56) References Cited

U.S. PATENT DOCUMENTS

| | | | | |
|---|---|---|---|---|
| 5,508,795 | A | 4/1996 | Kikuchi | |
| 2011/0305480 | A1* | 12/2011 | Tanaami | G03G 15/0147 399/112 |
| 2015/0010334 | A1* | 1/2015 | Nakajima | G03G 15/0877 399/258 |
| 2017/0315470 | A1* | 11/2017 | Mochizuki | G03G 15/0831 |
| 2017/0315501 | A1* | 11/2017 | Mochizuki | G03G 15/50 |

FOREIGN PATENT DOCUMENTS

| | | | |
|---|---|---|---|
| JP | 6258941 | A | 9/1994 |

* cited by examiner

*Primary Examiner* — Walter L Lindsay, Jr.
*Assistant Examiner* — Jessica L Eley
(74) *Attorney, Agent, or Firm* — Alleman Hall Creasman & Tuttle LLP

(57) ABSTRACT

An image forming apparatus includes a lock mechanism, a first determination processing portion, and a regulation processing portion. The lock mechanism is configured to regulate attachment and detachment of the developer storage portion attached to the attachment portion. The first determination processing portion determines whether or not the developer storage portion attached to the attachment portion is a developer storage portion of a predetermined specific type. The regulation processing portion, when the developer storage portion attached to the attachment portion has been determined to be a developer storage portion of the specific type, causes the lock mechanism to regulate attachment and detachment of the developer storage portion.

4 Claims, 5 Drawing Sheets

IMAGE FORMING APPARATUS FOR FORMING IMAGE USING DEVELOPER, METHOD FOR REGULATING ATTACHMENT/DETACHMENT OF DEVELOPER STORAGE PORTION

INCORPORATION BY REFERENCE

This application is based upon and claims the benefit of priority from the corresponding Japanese Patent Application No. 2016-091138 filed on Apr. 28, 2016, the entire contents of which are incorporated herein by reference.

BACKGROUND

The present disclosure relates to an image forming apparatus for forming an image by using developer, and a method implemented in an image forming apparatus to regulate attachment/detachment of a developer storage portion.

To an image forming apparatus such as a printer, a developer storage portion storing developer used for printing is attached, wherein the developer storage portion may be a toner container storing toner. In this type of image forming apparatus, the developer storage portion is replaced with a new one at an arbitrary timing by the user. Here, there is known an image forming apparatus that includes a lock mechanism configured to regulate attachment/detachment of the developer storage portion until an out of developer in the developer storage portion is detected so that the remaining amount of developer in the developer storage portion at the time of replacement is reduced.

SUMMARY

An image forming apparatus according to an aspect of the present disclosure includes an attachment portion, a lock mechanism, an image forming portion, a detection processing portion, a release processing portion, a first determination processing portion, and a regulation processing portion. To the attachment portion, a developer storage portion storing developer is attached. The lock mechanism is configured to regulate attachment and detachment of the developer storage portion attached to the attachment portion. The image forming portion is configured to execute a print process by using the developer. The detection processing portion is configured to detect whether or not the developer storage portion attached to the attachment portion is in a specific state in which a remaining amount of developer is smaller than a predetermined reference amount. The release processing portion is configured to, when the detection processing portion has detected that the developer storage portion is in the specific state, cause the lock mechanism to release a regulation on attachment and detachment of the developer storage portion. The first determination processing portion is configured to determine whether or not the developer storage portion attached to the attachment portion is a developer storage portion of a predetermined specific type. The regulation processing portion is configured to, when the first determination processing portion has determined that the developer storage portion attached to the attachment portion is a developer storage portion of the specific type, cause the lock mechanism to regulate attachment and detachment of the developer storage portion.

A method for regulating attachment and detachment of a developer storage portion, according to another aspect of the present disclosure, is implemented in an image forming apparatus that includes: an attachment portion to which a developer storage portion storing developer is attached; a lock mechanism configured to regulate attachment and detachment of the developer storage portion attached to the attachment portion; and an image forming portion configured to execute a print process by using the developer. The method includes a first step, a second step, a third step, and a fourth step. In the first step, it is detected whether or not the developer storage portion attached to the attachment portion is in a specific state in which a remaining amount of developer is smaller than a predetermined reference amount. In the second step, when it has been detected in the first step that the developer storage portion is in the specific state, the lock mechanism is caused to release a regulation on attachment and detachment of the developer storage portion. In the third step, it is determined whether or not the developer storage portion attached to the attachment portion is a developer storage portion of a predetermined specific type. In the fourth step, when it has been determined in the third step that the developer storage portion attached to the attachment portion is a developer storage portion of the specific type, the lock mechanism is caused to regulate attachment and detachment of the developer storage portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Outlined Configuration of Image Forming Apparatus 10]

Figure 1:
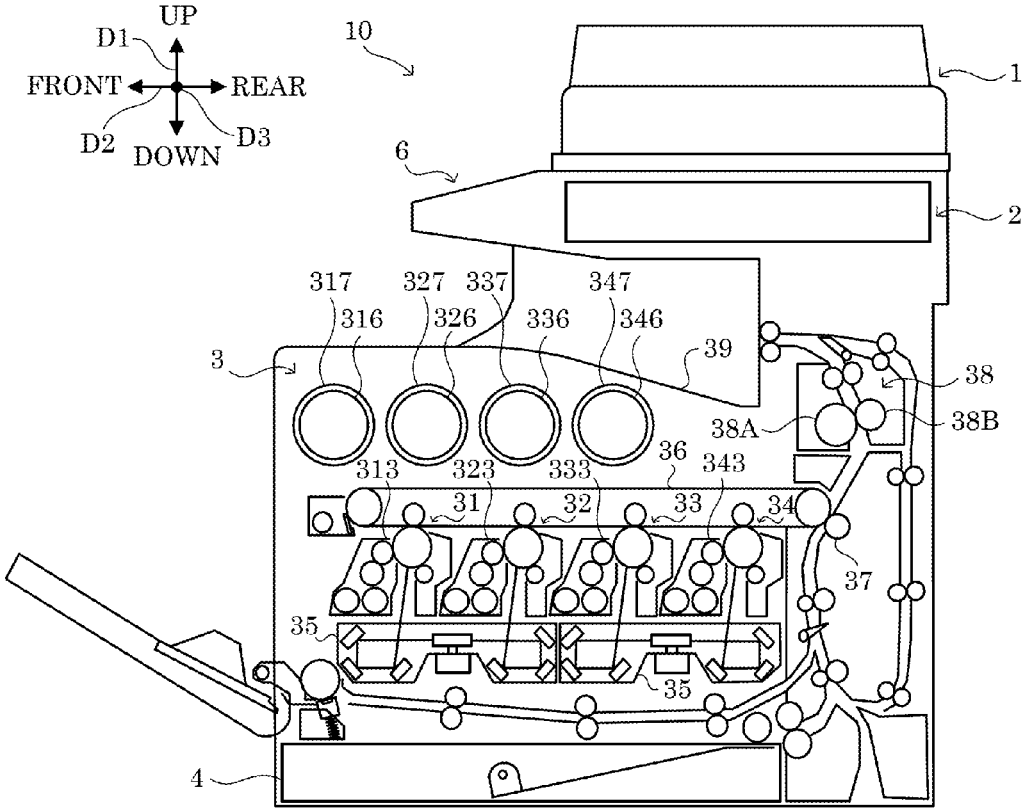
FIG. 1 is a diagram showing a configuration of an image forming apparatus according to an embodiment of the present disclosure.

First, a configuration of an image forming apparatus 10 according to an embodiment of the present disclosure is described with reference to FIG. 1 and FIG. 2. Here, FIG. 1 is a schematic cross-sectional view showing the configuration of the image forming apparatus 10. It is noted that in the following description, the up-down direction of FIG. 1 is defined as an up-down direction D1 of the image forming apparatus 10, the right-left direction of FIG. 1 is defined as a front-rear direction D2 of the image forming apparatus 10, and the depth direction of FIG. 1 is defined as a left-right direction D3 of the image forming apparatus 10.

The image forming apparatus 10 is a multifunction peripheral having a plurality of functions such as a print function for forming an image based on image data, a scan function, a facsimile function, and a copy function. It is noted that the present disclosure is applicable to other types of image forming apparatuses such as a printer device, a facsimile device, and a copier.

Figure 2:
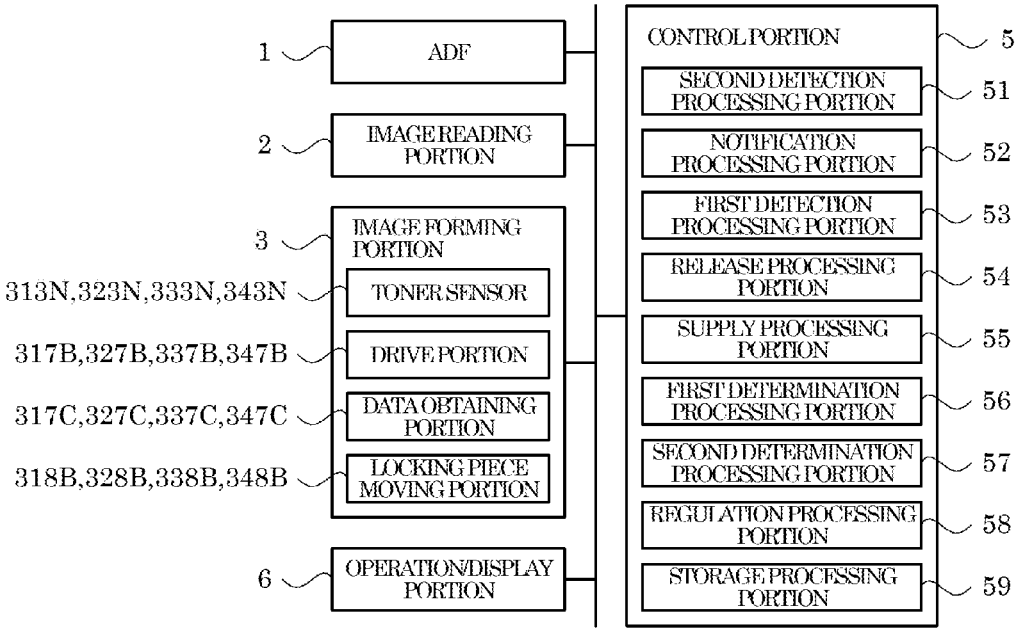
FIG. 2 is a block diagram showing a system configuration of the image forming apparatus according to the embodiment of the present disclosure.

As shown in FIG. 1 and FIG. 2, the image forming apparatus 10 includes an ADF 1, an image reading portion 2, an image forming portion 3, a sheet feed portion 4, a control portion 5, and an operation/display portion 6.

The sheet feed portion 4 supplies a sheet to the image forming portion 3. It is noted that the sheet is a sheet-like material such as a sheet of paper, a sheet of coated paper, a postcard, an envelope, or an OHP sheet.

The control portion 5 includes control equipment such as CPU, ROM, RAM, and EEPROM that are not shown. The CPU is a processor that executes various calculation processes. The ROM is a nonvolatile storage portion in which various information such as control programs for causing the CPU to execute various processes are stored in advance. The RAM is a volatile storage portion, and the EEPROM is a nonvolatile storage portion. The RAM and the EEPROM are used as temporary storage memory (working area) for the various processes executed by the CPU. In the control portion 5, the CPU executes the various control programs stored in advance in the ROM. This allows the image forming apparatus 10 to be controlled comprehensively by the control portion 5. It is noted that the control portion 5 may be formed as an electronic circuit such as an integrated circuit (ASIC), and may be a control portion provided independently of a main control portion that comprehensively controls the image forming apparatus 10.

The operation/display portion 6 includes a display portion and an operation portion, wherein the display portion is, for example, a liquid crystal display and displays various types of information in response to control instructions from the control portion 5, and the operation portion is, for example, operation keys or a touch panel which is configured to input various types of information to the control portion 5 in response to user operations.

[Configuration of Image Forming Portion 3]

Figure 3:
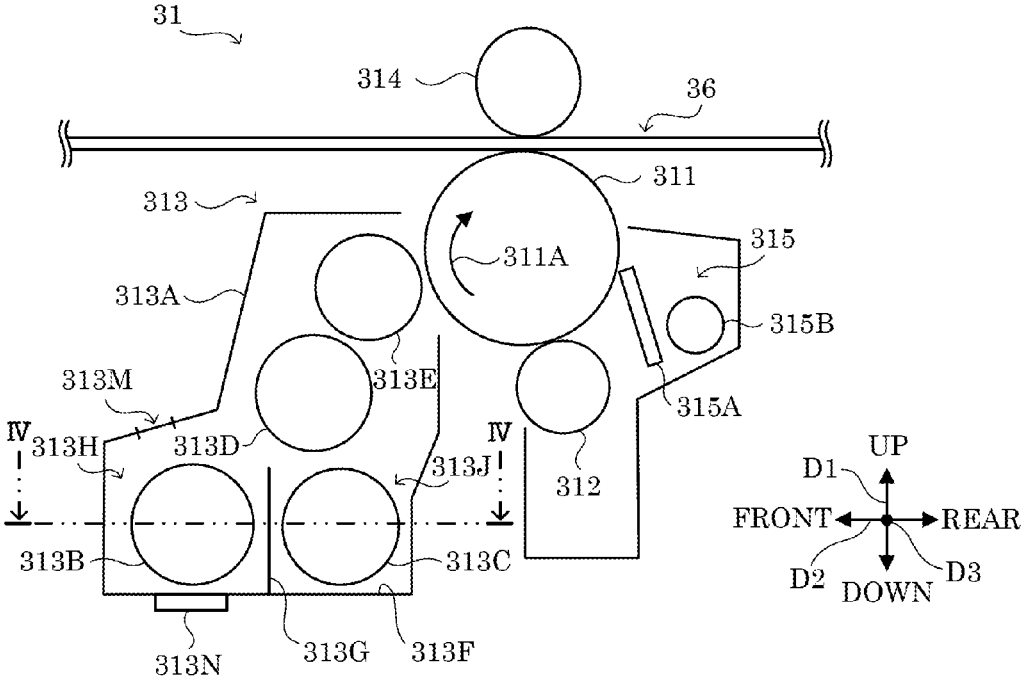
FIG. 3 is a diagram showing a configuration of an image forming unit of the image forming apparatus according to the embodiment of the present disclosure.
Figure 4:
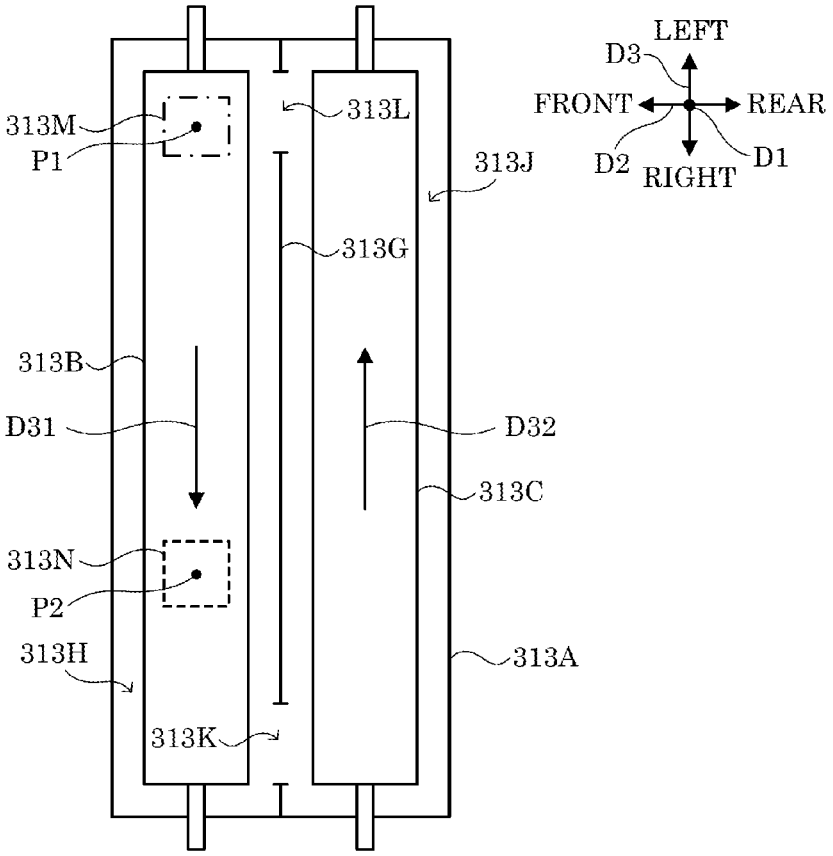
FIG. 4 is a diagram showing a configuration of a developing portion of the image forming apparatus according to the embodiment of the present disclosure.
Figure 5:
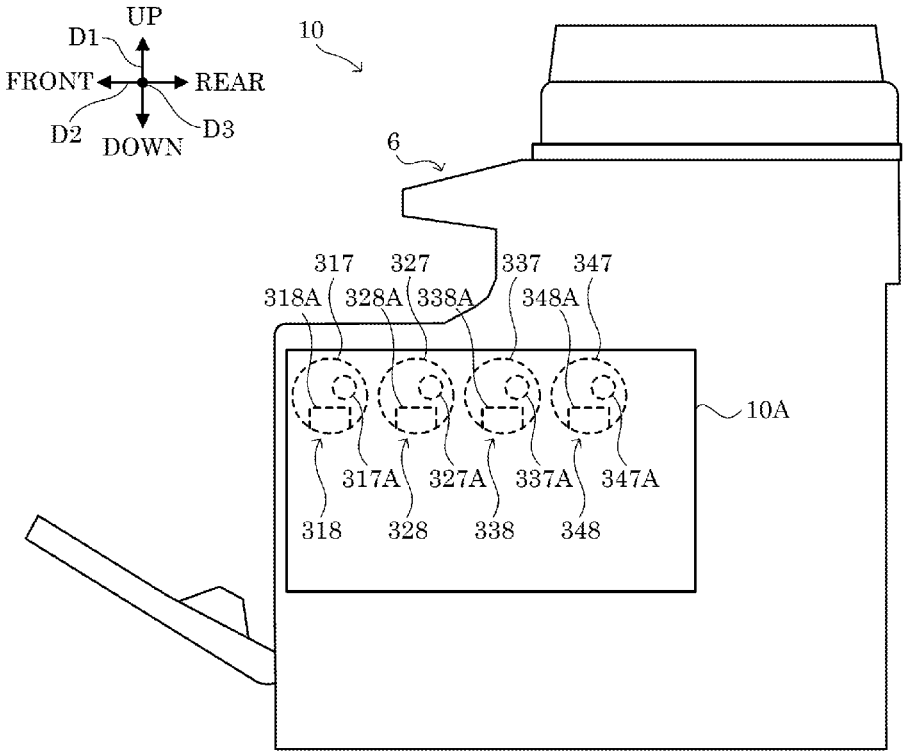
FIG. 5 is a diagram showing a configuration of attachment portions and lock mechanisms of the image forming apparatus according to the embodiment of the present disclosure.

Next, a configuration of the image forming portion 3 is described with reference to FIG. 1 to FIG. 5. Here, FIG. 3 is a schematic cross-sectional view showing a configuration of an image forming unit 31. FIG. 4 is a cross-sectional view taken along line IV-IV of FIG. 3, viewed from a direction indicated by the arrows of FIG. 3. FIG. 5 is a schematic diagram showing a configuration of the left side surface of the image forming apparatus 10. It is noted that the one-dot chain line of FIG. 4 indicates a position of an opening portion 313M in a developing portion 313.

The image forming portion 3 is configured to execute an image forming process (a print process) in which to form a color or monochrome image by the electrophotography method based on image data read by the image reading portion 2, or based on image data input from an external information processing apparatus such as a personal computer.

As shown in FIG. 1, the image forming portion 3 includes a plurality of image forming units 31 to 34, a laser scanning device 35, an intermediate transfer belt 36, a secondary transfer roller 37, a fixing device 38, and a sheet discharge tray 39.

The image forming units 31, 32, 33, and 34 are electrophotographic image forming units corresponding to Y (yellow), C (cyan), M (magenta), and K (black), respectively. As shown in FIG. 1, the image forming units 31 to 34 are arranged in alignment along the front-rear direction D2 of the image forming apparatus 10, in an order of yellow, cyan, magenta, and black from the front side of the image forming apparatus 10.

As shown in FIG. 3, the image forming unit 31 includes a photoconductor drum 311, a charging roller 312, a developing portion 313, a primary transfer roller 314, and a drum cleaning portion 315 In addition, the image forming units 32 to 34 have the same configuration as the image forming unit 31. For example, as shown in FIG. 1, the image forming units 32, 33, and 34 respectively include developing portions 323, 333, and 343.

An electrostatic latent image is formed on the surface of the photoconductor drum 311.

The charging roller 312 charges the photoconductor drum 311.

The developing portion 313 develops the electrostatic latent image formed on the photoconductor drum 311 by using developer including toner (an example of the developer of the present disclosure) and carrier. The developing portion 313 is described in detail below.

The primary transfer roller 314 transfers a toner image that has been formed on the surface of the photoconductor drum 311 by the developing portion 313, to the intermediate transfer belt 36.

The drum cleaning portion 315 removes residual toner from the surface of the photoconductor drum 311.

The laser scanning device 35 forms the electrostatic latent image on the surface of each of the photoconductor drums respectively included in the image forming units 31 to 34.

The intermediate transfer belt 36 is an endless belt member to which the toner images formed on the surfaces of the photoconductor drums of the image forming units 31 to 34 are transferred. The driving roller is driven to rotate by a driving force supplied from a power source (not shown). This allows the intermediate transfer belt 36 to move along the front-rear direction D2 of the image forming apparatus 10.

The secondary transfer roller 37 transfers the toner images adhered to the surface of the intermediate transfer belt 36, to the sheet.

The fixing device 38 fuses and fixes, to the sheet, the toner images transferred to the sheet by the secondary transfer roller 37.

The sheet with the toner images fixed thereto by the fixing device 38 is discharged to the sheet discharge tray 39.

In the image forming portion 3, a color image is formed on the sheet supplied from the sheet feed portion 4 in the procedures described below, and the sheet with the color image formed thereon is discharged to the sheet discharge tray 39.

First, in the image forming unit 31, the charging roller 312 charges the photoconductor drum 311 uniformly to a certain potential. Next, the laser scanning device 35 irradiates light onto the surface of the photoconductor drum 311 based on image data. This allows an electrostatic latent image corresponding to the image data to be formed on the surface of the photoconductor drum 311. The electrostatic latent image on the surface of the photoconductor drum 311 is developed (visualized) as a toner image of yellow by the developing portion 313.

Subsequently, the yellow toner image formed on the photoconductor drum 311 is transferred to the intermediate transfer belt 36 by the primary transfer roller 314. On the other hand, the residual toner on the surface of the photoconductor drum 311 is removed by the drum cleaning portion 315. For example, in the drum cleaning portion 315, the residual toner on the surface of the photoconductor drum 311 is removed by a cleaning member 315A. The toner removed by the cleaning member 315A is conveyed by a conveyance screw 315B to a toner storage container (not shown) and collected in the toner storage container.

It is noted that in the image forming units 32 to 34, too, toner images of respective colors are formed on the photoconductor drums of the image forming units 32 to 34, and the toner images are overlaid on and transferred to the intermediate transfer belt 36 in an order of yellow, cyan, magenta, and black. Subsequently, the toner images transferred to the intermediate transfer belt 36 are transferred to the sheet supplied from the sheet feed portion 4, by the secondary transfer roller 37. Thereafter, the sheet with the toner images transferred thereon is heated by the fixing device 38 so that an image is formed on the sheet, and the sheet is discharged to the sheet discharge tray 39.

Next, the developing portion 313 is described in detail. It is noted that the developing portions 323, 333, and 343 have the same configuration as the developing portion 313 described below.

As shown in FIG. 3 and FIG. 4, the developing portion 313 includes a housing 313A, a first conveyance member 313B, a second conveyance member 313C, a magnet roller 313D, a developing roller 313E, and a toner sensor 313N.

As shown in FIG. 3, the housing 313A stores the first conveyance member 313B, the second conveyance member 313C, the magnet roller 313D, and the developing roller 313E. In addition, the housing 313A stores the developer. Specifically, the housing 313A stores the developer in an inner space that is formed by side walls and a bottom surface 313F.

As shown in FIG. 4, the housing 313A includes a first conveyance path 313H and a second conveyance path 313J along which the developer including the toner is conveyed. Specifically, as shown in FIG. 3 and FIG. 4, a partition wall 313G is formed on the bottom surface 313F of the housing 313A. The side walls of the housing 313A, the bottom surface 313F, and the partition wall 313G form the first conveyance path 313H along which the developer is conveyed into the housing 313A. In addition, the side walls of the housing 313A, the bottom surface 313F, and the partition wall 313G form the second conveyance path 313J along which the developer is conveyed into the housing 313A.

As shown in FIG. 4, the first conveyance member 313B is provided in the first conveyance path 313H. In the first conveyance path 313H, the first conveyance member 313B conveys the developer along a right direction D31 of the left-right direction D3, and electrically charges the toner included in the developer. Specifically, the first conveyance member 313B, during the conveyance of the developer, stirs the developer and charges the toner included in the developer. The first conveyance member 313B is a stirring screw, for example.

As shown in FIG. 4, the second conveyance member 313C is provided in the second conveyance path 313J. In the second conveyance path 313J, the second conveyance member 313C conveys the developer along a left direction D32 of the image forming portion 3, and electrically charges the toner included in the developer. Specifically, the second conveyance member 313C, during the conveyance of the developer, stirs the developer and charges the toner included in the developer. The second conveyance member 313C is a stirring screw, for example.

A first connection portion 313K that connects the first conveyance path 313H with the second conveyance path 313J, is provided in the partition wall 313G at a position on the downstream side in the conveyance direction of the developer conveyed by the first conveyance member 313B. On the other hand, a second connection portion 313L that connects the first conveyance path 313H with the second conveyance path 313J, is provided in the partition wall 313G at a position on the downstream side in the conveyance direction of the developer conveyed by the second conveyance member 313C. With this configuration, the developer stored in the housing 313A is conveyed by the first conveyance member 313B and the second conveyance member 313C in such a way as to circulate through the first conveyance path 313H and the second conveyance path 313J.

The magnet roller 313D obtains the developer conveyed by the second conveyance member 313C. The magnet roller 313D then supplies, to the developing roller 313E, the toner included in the developer obtained from the second conveyance member 313C. The developing roller 313E develops the electrostatic latent image formed on the surface of the photoconductor drum 311, by using the toner supplied from the magnet roller 313D.

It is noted that the developing method of the developing portion 313 is not limited to the above-described two-component developing method that uses toner and carrier. For example, the developing method of the developing portion 313 may be a one-component developing method that uses only toner. In addition, the developing portion 313 may not include the magnet roller 313D.

The opening portion 313M is provided in the first conveyance path 313H at a position on the upstream side in the conveyance direction of the developer conveyed by the first conveyance member 313B. As shown in FIG. 3, for example, the opening portion 313M is provided in an upper surface of the housing 313A in a portion above the first conveyance path 313H. The opening portion 313M is used to supply the toner supplied from a toner container 316 that is described below, into the first conveyance path 313H. Specifically, the toner supplied from the toner container 316 passes through the opening portion 313M and is supplied into the first conveyance path 313H at a conveyance position P1 (see FIG. 4).

The toner sensor 313N is configured to detect an amount of toner at a detection position P2 (see FIG. 4) that is more on the downstream side than the opening portion 313M of the first conveyance path 313H, in the conveyance direction of the developer conveyed by the first conveyance member 313B. The toner sensor 313N is, for example, provided on a bottom of the housing 313A, as shown in FIG. 3. The toner sensor 313N is, for example, a permeability sensor including an LC oscillator that outputs an electric signal corresponding to a permeability of the developer stored in the housing 313A.

For example, in the image forming apparatus 10, a remaining amount of toner in the developing portion 313 is obtained by integrating the values detected by the toner sensor 313N during a detection period that is longer than the time required for the first conveyance member 313B to convey the toner from the conveyance position P1 to the detection position P2. For example, the detection period equals to a time period required for the toner conveyed by the first conveyance member 313B to circulate the developing portion 313 once. It is noted that the detection period may be longer or shorter than the time period required for the toner conveyed by the first conveyance member 313B to circulate the developing portion 313 once.

As shown in FIG. 1, toner containers 316, 326, 336, and 346 are attached to the image forming portion 3. The toner container 316 stores yellow toner that is supplied to the image forming unit 31. The toner container 326 stores cyan toner that is supplied to the image forming unit 32. The toner container 336 stores magenta toner that is supplied to the image forming unit 33. The toner container 346 stores black toner that is supplied to the image forming unit 34. It is noted that the toner containers 316, 326, 336, and 346 have the same configuration, except that colors of the toner stored therein are different. Accordingly, in the following, only the toner container 316 is described.

The toner container 316 is, for example, an elongated, substantially cylindrical container extending along the left-right direction D3. The toner container 316 includes a conveyance member (not shown) that conveys the toner inside the toner container 316, and an IC tag that stores specific data regarding the toner container 316. For example, the specific data includes identification information of the toner container 316, quality determination information, a color of the toner stored therein, and a remaining amount of the toner stored therein.

In addition, as shown in FIG. 1 and FIG. 5, the image forming portion 3 further includes attachment portions 317, 327, 337, and 347, and lock mechanisms 318, 328, 338, and 348. It is noted that the attachment portions 317, 327, 337, and 347 have the same configuration, except that the toner containers attached thereto are different. In addition, the lock mechanisms 318, 328, 338, and 348 have the same configuration, except that the toner containers whose attachment and detachment are regulated by them are different. Accordingly, in the following, only the attachment portion 317 and the lock mechanism 318 are described.

The toner container 316 is attached to the attachment portion 317. The attachment portion 317 is, for example, provided in an upper portion of the image forming portion 3 so as to be elongated along the left-right direction D3, as shown in FIG. 1 and FIG. 5. The attachment portion 317 is covered with a housing cover 10A, as shown in FIG. 5. Here, the toner container 316 is an example of the developer storage portion of the present disclosure.

The housing cover 10A is a cover member provided on an outer side of the image forming apparatus 10 in such a way as to be opened and closed. Specifically, as shown in FIG. 5, the housing cover 10A is provided on the right side surface of the image forming apparatus 10 in correspondence with arrangement positions of the attachment portions 317, 327, 337, and 347. The housing cover 10A is opened and closed, for example, by a hinge provided at one of opposite end portions thereof in the front-rear direction D2. When any of the toner containers 316, 326, 336, and 346 is attached or detached, the housing cover 10A is opened and the attachment portions 317, 327, 337, and 347 are exposed to the outside. It is noted that an open/close detection switch (not shown) is provided at an end portion of the housing cover 10A that is opposite to the end portion having the hinge, the open/close detection switch being configured to detect whether the housing cover 10A is opened or closed. The open/close detection switch inputs, to the control portion 5, an electric signal corresponding to the opened or closed state of the housing cover 10A.

As shown in FIG. 5, a connection portion 317A is provided in the left end portion of the attachment portion 317 in the left-right direction D3. The connection portion 317A is engaged with the conveyance member which is included in the toner container 316 attached to the attachment portion 317. The connection portion 317A is, for example, a gear. In addition, the image forming portion 3 includes a drive portion 317B (see FIG. 2) that is, for example, a motor and supplies a driving force to the conveyance member of the toner container 316 attached to the attachment portion 317 via the connection portion 317A. When the conveyance member is driven by the driving force that is supplied from the drive portion 317B via the connection portion 317A, the toner is supplied from the toner container 316 to the image forming unit 31.

The attachment portion 317 includes a data obtaining portion 317C (see FIG. 2) that obtains the specific data from the IC tag included in the toner container 316. For example, the data obtaining portion 317C receives the specific data from the IC tag by performing a wireless communication with the IC tag included in the toner container 316 attached to the attachment portion 317.

The lock mechanism 318 regulates attachment/detachment (replacement) of the toner container 316 attached to the attachment portion 317. The lock mechanism 318, for example, includes a locking piece 318A and a locking piece moving portion 318B, as shown in FIG. 2 and FIG. 5. The locking piece 318A is provided in the right end portion of the attachment portion 317 in the left-right direction D3, as shown in FIG. 5. The locking piece 318A is provided, for example, in such a way as to move along the up-down direction D1 between a closing position for closing and an opening position for opening the right end portion of the attachment portion 317. The locking piece moving portion 318B moves the locking piece 318A between the closing position and the opening position. The locking piece moving portion 318B is, for example, a solenoid. In the lock mechanism 318, for example, the locking piece 318A is held at either the closing position or the opening position depending on whether power is supplied from a power source portion (not shown) to the locking piece moving portion 318B.

In the image forming apparatus 10, when a first state (out of toner) in which the remaining amount of toner in the toner container 316 is less than a predetermined first reference amount, is detected, the regulation on attachment/detachment of the toner container 316 by the lock mechanism 318 is released. Here, the first reference amount is an example of the reference amount of the present disclosure. In addition, the first state is an example of the specific state of the present disclosure.

In the image forming apparatus 10, after the toner container 316 is replaced following the detection of the first state, a supply process is executed to cause the toner container 316 to supply toner to the developing portion 313 until the remaining amount of toner in the developing portion 313 detected by the toner sensor 313N exceeds a predetermined threshold.

Meanwhile, when the toner stored in the toner container 316 does not match the image forming apparatus 10, the quality of the image printed by the image forming apparatus 10 may be degraded. Here, in a case where the attachment/detachment of the toner container 316 storing toner not matching the image forming apparatus 10 is regulated by the lock mechanism 318, the toner container 316 cannot be replaced until the first state is detected.

On the other hand, in the image forming apparatus 10 according to the embodiment of the present disclosure, as described below, it is possible to reduce the remaining amount of toner in the toner container 316 at the time of replacement, and avoid the attachment/detachment of the toner container 316 storing toner that does not match its associated image forming apparatus, from being regulated.

Specifically, an attachment/detachment regulation control program is stored in the ROM of the control portion 5 in advance, wherein the attachment/detachment regulation control program causes the CPU to execute an attachment/detachment regulation process (see the flowchart of FIG. 6) and a type determination process (see the flowchart of FIG. 7) that are described below. It is noted that the attachment/detachment regulation control program may be recorded on a computer-readable recording medium such as a CD, a DVD, or a flash memory, and read from the recording medium and installed into a storage portion, such as the EEPROM, of the control portion 5.

As shown in FIG. 2, the control portion 5 includes a second detection processing portion 51, a notification processing portion 52, a first detection processing portion 53, a release processing portion 54, a supply processing portion 55, a first determination processing portion 56, a second determination processing portion 57, a regulation processing portion 58, and a storage processing portion 59. Specifically, the control portion 5 executes the attachment/detachment regulation control program stored in the ROM by using the CPU. This allows the control portion 5 to function as the second detection processing portion 51, the notification processing portion 52, the first detection processing portion 53, the release processing portion 54, the supply processing portion 55, the first determination processing portion 56, the second determination processing portion 57, the regulation processing portion 58, and the storage processing portion 59.

It is noted that in the following, a case involving the developing portion 313, the toner container 316, the attachment portion 317, and the lock mechanism 318 is explained as one example. The following explanation also applies to the cases involving the developing portions 323, 333, and 343, the toner containers 326, 336, and 346, the attachment portions 327, 337, and 347, and the lock mechanisms 328, 338, and 348, respectively.

The second detection processing portion 51 is configured to detect whether or not the toner container 316 attached to the attachment portion 317 is in a second state in which the remaining amount of toner in the toner container is equal to or larger than the first reference amount and smaller than a predetermined second reference amount that is larger than the first reference amount.

For example, the second detection processing portion 51 detects whether or not the toner container 316 is in the second state based on the remaining amount of toner in the developing portion 313 detected by the toner sensor 313N. For example, the second detection processing portion 51 detects the second state based on an increase rate of the remaining amount of toner in the developing portion 313 detected by the toner sensor 313N when the toner is supplied from the toner container 316 to the developing portion 313 during the print process.

It is noted that the second detection processing portion 51 may detect the second state by calculating a toner consumption amount based on a printing rate of image data printed in the print process, and comparing a cumulative value of the calculated toner consumption amount with an amount of toner stored in the toner container 316. In addition, the second detection processing portion 51 may detect the second state by calculating an amount of toner conveyed from the toner container 316 based on a time period for which the conveyance member is driven by the drive portion 317B, and comparing a cumulative value of the calculated toner conveyance amount with the amount of toner stored in the toner container 316.

When the second detection processing portion 51 has detected that the toner container 316 is in the second state, the notification processing portion 52 notifies about it.

The first detection processing portion 53 is configured to detect whether or not the toner container 316 attached to the attachment portion 317 is in a first state in which the remaining amount of toner in the toner container is smaller than the first reference amount. Here, the first detection processing portion 53 is an example of the detection processing portion of the present disclosure.

For example, as is the case with the second detection processing portion 51, the first detection processing portion 53 detects whether or not the toner container 316 is in the first state based on the remaining amount of toner in the developing portion 313 detected by the toner sensor 313N. For example, the first detection processing portion 53 detects whether or not the toner container 316 is in the first state based on the increase rate of the remaining amount of toner in the developing portion 313 detected by the toner sensor 313N when the toner is supplied from the toner container 316 to the developing portion 313 during the print process.

It is noted that the first detection processing portion 53 may detect the first state by calculating a toner consumption amount based on a printing rate of image data printed in the print process, and comparing a cumulative value of the calculated toner consumption amount with an amount of toner stored in the toner container 316. In addition, the first detection processing portion 53 may detect whether or not the toner container 316 is in the first state by calculating an amount of toner conveyed from the toner container 316 based on a time period for which the conveyance member is driven by the drive portion 317B, and comparing a cumulative value of the calculated toner conveyance amount with the amount of toner stored in the toner container 316.

The release processing portion 54, when the first detection processing portion 53 has detected that the toner container 316 is in the first state, causes the lock mechanism 318 to release the regulation on attachment/detachment of the toner container 316.

For example, the release processing portion 54 causes the power source portion to supply power to the locking piece moving portion 318B. With this execution, in the lock mechanism 318, the locking piece 318A is moved from the closing position to the opening position, and is held in the opening position.

The supply processing portion 55, upon determining that the toner container 316 has been replaced with a new one in a state where the regulation on attachment/detachment of the toner container 316 had been released by the release processing portion 54, executes the supply process to cause the toner container 316 to supply toner to the developing portion 313 until the remaining amount of toner in the developing portion 313 detected by the toner sensor 313N exceeds the threshold.

For example, in a case where the open/close detection switch detects opening and then closing of the housing cover 10A, and the second determination processing portion 57 determines that the toner container 316 is attached to the attachment portion 317, the supply processing portion 55 determines that the toner container 316 has been replaced with a new one.

For example, in the supply process, the supply processing portion 55 controls the drive portion 317B to drive the conveyance member of the toner container 316.

The first determination processing portion 56 determines whether or not the toner container 316 attached to the attachment portion 317 is a toner container of a predetermined specific type. For example, the toner container of the specific type is a toner container that was manufactured by one or more predetermined manufacturing principals.

For example, the first determination processing portion 56, when the supply process is executed by the supply processing portion 55, determines whether or not the toner container 316 attached to the attachment portion 317 is a toner container of the specific type. Specifically, the first determination processing portion 56, when the supply process is executed by the supply processing portion 55, causes the data obtaining portion 317C to obtain the specific data from the IC tag of the toner container 316. Subsequently, the first determination processing portion 56 determines whether or not the toner container 316 attached to the attachment portion 317 is a toner container of the specific type, based on the identification information or the quality determination information included in the specific data.

The second determination processing portion 57 determines whether or not the toner container 316 is attached to the attachment portion 317. For example, the image forming apparatus 10 includes a first sensor (not shown) configured to detect whether or not the toner container 316 is attached to the attachment portion 317. The second determination processing portion 57 determines whether or not the toner container 316 is attached to the attachment portion 317, by using the first sensor.

The regulation processing portion 58, when the first determination processing portion 56 has determined that the toner container 316 attached to the attachment portion 317 is a toner container of the specific type, causes the lock mechanism 318 to regulate attachment/detachment of the toner container 316.

For example, the regulation processing portion 58 causes the power source portion to stop supplying power to the locking piece moving portion 318B. With this execution, in the lock mechanism 318, the locking piece 318A is moved from the opening position to the closing position, and is held at the closing position.

In a case where the second determination processing portion 57 has determined that the toner container 316 is attached to the attachment portion 317, and further the first determination processing portion 56 has determined that the toner container 316 attached to the attachment portion 317 is not a toner container of the specific type, the notification processing portion 52 notifies about it. In this case, the lock mechanism 318 is not caused to regulate the attachment/detachment of the toner container 316 determined not to be a toner container of the specific type.

The storage processing portion 59, when the attachment/detachment of the toner container 316 is regulated by the regulation processing portion 58, stores the specific data obtained from the toner container 316 by the data obtaining portion 317C, into a predetermined specific storage area of the EEPROM. Here, the storage area of the EEPROM is an example of the storage portion of the present disclosure.

The first determination processing portion 56, each time a predetermined timing comes, determines whether or not the toner container 316 attached to the attachment portion 317 is a toner container of the specific type, except when the supply process is executed by the supply processing portion 55. For example, the predetermined timing includes a timing when the open/close detection switch detects closing of the housing cover 10A after detecting opening of the housing cover 10A, and a timing when the image forming apparatus 10 is powered on.

For example, each time the predetermined timing comes, if the attachment/detachment of the toner container 316 is regulated by the lock mechanism 318, the first determination processing portion 56 determines whether or not the toner container 316 attached to the attachment portion 317 is a toner container of the specific type based on the specific data stored in the specific storage area by the storage processing portion 59.

On the other hand, each time the predetermined timing comes, if the attachment/detachment of the toner container 316 is not regulated by the lock mechanism 318, the first determination processing portion 56 causes the data obtaining portion 317C to obtain the specific data, and determines whether or not the toner container 316 is a toner container of the specific type based on the obtained specific data.

For example, the image forming apparatus 10 includes a second sensor (not shown) in the attachment portion 317, wherein the second sensor is configured to detect whether or not attachment/detachment of the toner container 316 is regulated by the lock mechanism 318. The second determination processing portion 57 determines whether or not attachment/detachment of the toner container 316 is regulated by the lock mechanism 318, by using the second sensor.

[Attachment/Detachment Regulation Process]

Figure 6:
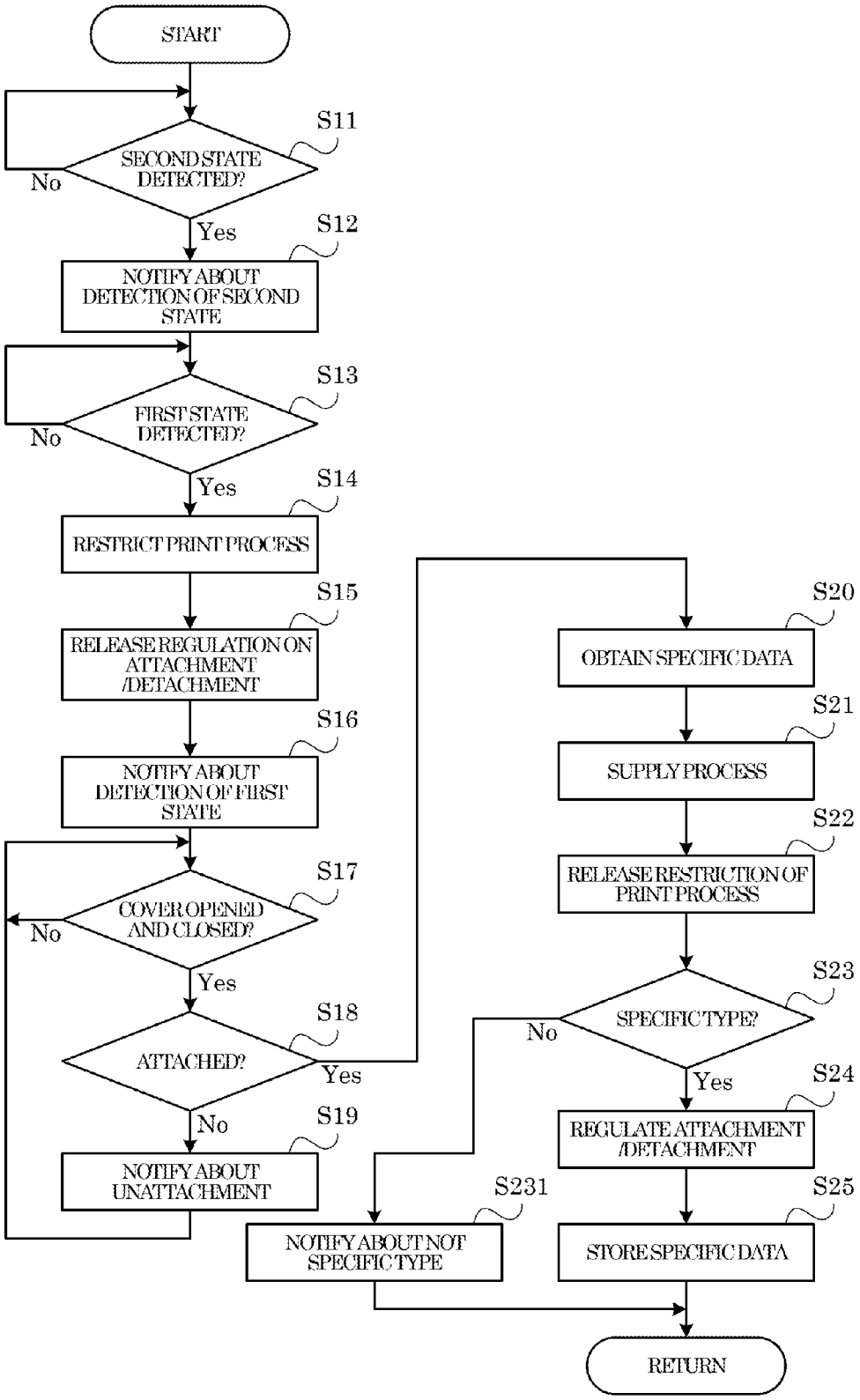
FIG. 6 is a flowchart showing an example of an attachment/detachment regulation process executed by the image forming apparatus according to the embodiment of the present disclosure.

In the following, with reference to FIG. 6, a description is given of an example of the procedure of the attachment/detachment regulation process executed by the control portion 5 in the image forming apparatus 10. Here, steps S11, S12, . . . represent numbers assigned to the processing procedures (steps) executed by the control portion 5.

<Step S11>

First, in step S11, the control portion 5 detects whether or not the toner container 316 attached to the attachment portion 317 is in the second state, wherein in the second state, the remaining amount of toner in the toner container is equal to or larger than the first reference amount and smaller than the second reference amount. Here, the process of step S11 is executed by the second detection processing portion 51 of the control portion 5.

The control portion 5, for example, detects whether or not the toner container 316 is in the second state based on the remaining amount of toner in the developing portion 313 detected by the toner sensor 313N. For example, the control portion 5 detects whether or not the toner container 316 is in the second state based on an increase rate of the remaining amount of toner in the developing portion 313 detected by the toner sensor 313N when the toner is supplied from the toner container 316 to the developing portion 313 during the print process.

Here, upon detecting that the toner container 316 is in the second state (Yes side at S11), the control portion 5 moves the process to step S12. On the other hand, upon detecting that the toner container 316 is not in the second state (No side at S11), the control portion 5 waits at step S11 to detect that the toner container 316 is in the second state.

<Step S12>

In step S12, the control portion 5 notifies that the toner container 316 has been detected to be in the second state.

Here, the process of step S12 is executed by the notification processing portion 52 of the control portion 5.

For example, the control portion 5 displays, on the operation/display portion 6, a message indicating that the toner container 316 has been detected to be in the second state. This allows the user to recognize that the remaining amount of toner in the toner container 316 has decreased, and prepare a new toner container 316 before the toner container 316 runs out of toner.

<Step S13>

In step S13, determines whether or not the toner container 316 attached to the attachment portion 317 is in the first state, wherein in the first state, the remaining amount of toner in the toner container is smaller than the first reference amount. Here, the process of step S13 is an example of the first step of the present disclosure, and executed by the first detection processing portion 53 of the control portion 5.

For example, as is the case with step S11, the control portion 5 determines whether or not the toner container 316 is in the first state based on the remaining amount of toner in the developing portion 313 detected by the toner sensor 313N. For example, the control portion 5 detects whether or not the toner container 316 is in the first state based on the increase rate of the remaining amount of toner in the developing portion 313 detected by the toner sensor 313N when the toner is supplied from the toner container 316 to the developing portion 313 during the print process.

Here, upon determining that the toner container 316 is in the first state (Yes side at S13), the control portion 5 moves the process to step S14. On the other hand, upon determining that the toner container 316 is not in the first state (No side at S13), the control portion 5 waits at step S13 to detect that the toner container 316 is in the first state.

<Step S14>

In step S14, the control portion 5 restricts an execution of the print process by the image forming portion 3.

For example, in a case where the print process is being executed, the control portion 5 stops the print process. In addition, in a case where the print process is not being executed, the control portion 5 prohibits the execution of the print process. It is noted that in the case where the print process is being executed, the control portion 5 may stop the print process after outputting a predetermined number of sheets. This prevents the image forming apparatus 10 from outputting a print with low printing density.

<Step S15>

In step S15, the control portion 5 causes the lock mechanism 318 to release the regulation on attachment/detachment of the toner container 316. Here, the process of step S15 is an example of the second step of the present disclosure, and executed by the release processing portion 54 of the control portion 5.

For example, the control portion 5 causes the power source portion to supply power to the locking piece moving portion 318B. With this execution, in the lock mechanism 318, the locking piece 318A is moved from the closing position to the opening position, and is held in the opening position. This allows for a replacement of the toner container 316.

<Step S16>

In step S16, the control portion 5 notifies that the toner container 316 has been detected to be in the first state.

For example, the control portion 5 displays, on the operation/display portion 6, a message indicating that the toner container 316 has been detected to be in the first state. This allows the user to recognize that the toner container 316 has run out of toner, and perform a replacement of the toner container 316.

<Step S17>

In step S17, the control portion 5 determines whether or not the housing cover 10A has been opened and closed. Specifically, when the open/close detection switch has detected closing of the housing cover 10A after detecting opening of the housing cover 10A, the control portion 5 determines that the housing cover 10A has been opened and closed.

Here, upon determining that the housing cover 10A has been opened and closed (Yes side at S17), the control portion 5 moves the process to step S18. On the other hand, upon determining that the housing cover 10A has not been opened and closed (No side at S17), the control portion 5 waits at step S17 for the housing cover 10A to be opened and closed.

<Step S18>

In step S18, the control portion 5 determines whether or not the toner container 316 is attached to the attachment portion 317. Here, the process of step S18 is executed by the second determination processing portion 57 of the control portion 5.

For example, the control portion 5 determines whether or not the toner container 316 is attached to the attachment portion 317, by using the first sensor.

Here, upon determining that the toner container 316 is attached to the attachment portion 317 (Yes side at S18), the control portion 5 moves the process to step S20. On the other hand, upon determining that the toner container 316 is not attached to the attachment portion 317 (No side at S18), the control portion 5 moves the process to step S19.

<Step S19>

In step S19, the control portion 5 notifies that the toner container 316 is not attached to the attachment portion 317. For example, the control portion 5 displays, on the operation/display portion 6, a message indicating that the toner container 316 is not attached to the attachment portion 317. The control portion 5 then moves the process to step S17. This allows the user to recognize that the user has not attached the toner container 316.

<Step S20>

In step S20, the control portion 5 causes the data obtaining portion 317C to obtain the specific data from the IC tag of the toner container 316. Here, the process of step S20 is executed by the first determination processing portion 56 of the control portion 5.

<Step S21>

In step S21, the control portion 5 executes the supply process of causing the toner container 316 to supply toner to the developing portion 313 until the remaining amount of toner in the developing portion 313 detected by the toner sensor 313N exceeds the threshold. After the supply process is completed, the control portion 5 moves the process to step S22. Here, the process of step S21 is executed by the supply processing portion 55 of the control portion 5.

For example, in the supply process, the control portion 5 controls the drive portion 317B to drive the conveyance member of the toner container 316.

<Step S22>

In step S22, the control portion 5 releases the restriction of execution of the print process that was made in step S14. For example, in a case where the control portion 5 has stopped the print process in step S14, the control portion 5 resumes the execution of the print process. In addition, in a case where the control portion 5 has prohibited the execution of the print process in step S14, the control portion 5 releases the prohibition of execution of the print process.

<Step S23>

In step S23, the control portion 5 determines whether or not the toner container 316 attached to the attachment portion 317 is a toner container of the specific type. Here, the process of step S23 is an example of the third step of the present disclosure, and executed by the first determination processing portion 56 of the control portion 5.

For example, the control portion 5 determines whether or not the toner container 316 attached to the attachment portion 317 is a toner container of the specific type, based on the identification information or the quality determination information included in the specific data obtained in step S20.

Here, upon determining that the toner container 316 attached to the attachment portion 317 is a toner container of the specific type (Yes side at S23), the control portion 5 moves the process to step S24. On the other hand, upon determining that the toner container 316 attached to the attachment portion 317 is not a toner container of the specific type (No side at S23), the control portion 5 moves the process to step S231.

<Step S231>

In step S231, the control portion 5 notifies that the toner container 316 attached to the attachment portion 317 is not a toner container of the specific type. For example, the control portion 5 displays, on the operation/display portion 6, a message indicating that the toner container 316 attached to the attachment portion 317 is not a toner container of the specific type. This urges to replace the toner container 316 attached to the attachment portion 317 with a toner container of the specific type. Here, the process of step S231 is executed by the notification processing portion 52 of the control portion 5.

<Step S24>

In step S24, the control portion 5 causes the lock mechanism 318 to regulate attachment/detachment of the toner container 316. Here, the process of step S24 is an example of the fourth step of the present disclosure, and executed by the regulation processing portion 58 of the control portion 5.

For example, the control portion 5 controls the locking piece moving portion 318B to move the locking piece 318A from the opening position to the closing position. This restricts replacement of the toner container 316.

<Step S25>

In step S25, the control portion 5 stores the specific data obtained in step S20 into the specific storage area of the EEPROM. Here, the process of step S25 is executed by the storage processing portion 59 of the control portion 5.

Meanwhile, in the image forming apparatus 10, there may be a case where either or both of the attachment portion 317 and the IC tag of the toner container 316 are failed, and the specific data cannot be obtained from the IC tag. In such a case, according to a conventional image forming apparatus, the toner container 316 attached to the attachment portion 317 is determined not to be a toner container of the specific type, since the specific data cannot be obtained. As a result, even in a case where a toner container of the specific type is attached to the attachment portion 317, a notification indicating that the toner container 316 attached to the attachment portion 317 is not a toner container of the specific type, may be made each time the predetermined timing comes.

On the other hand, in the image forming apparatus 10, the type determination process explained in the following is executed, and an erroneous notification is restricted even in a case where either or both of the attachment portion 317 and the IC tag of the toner container 316 are failed.

[Type Determination Process]

Figure 7:
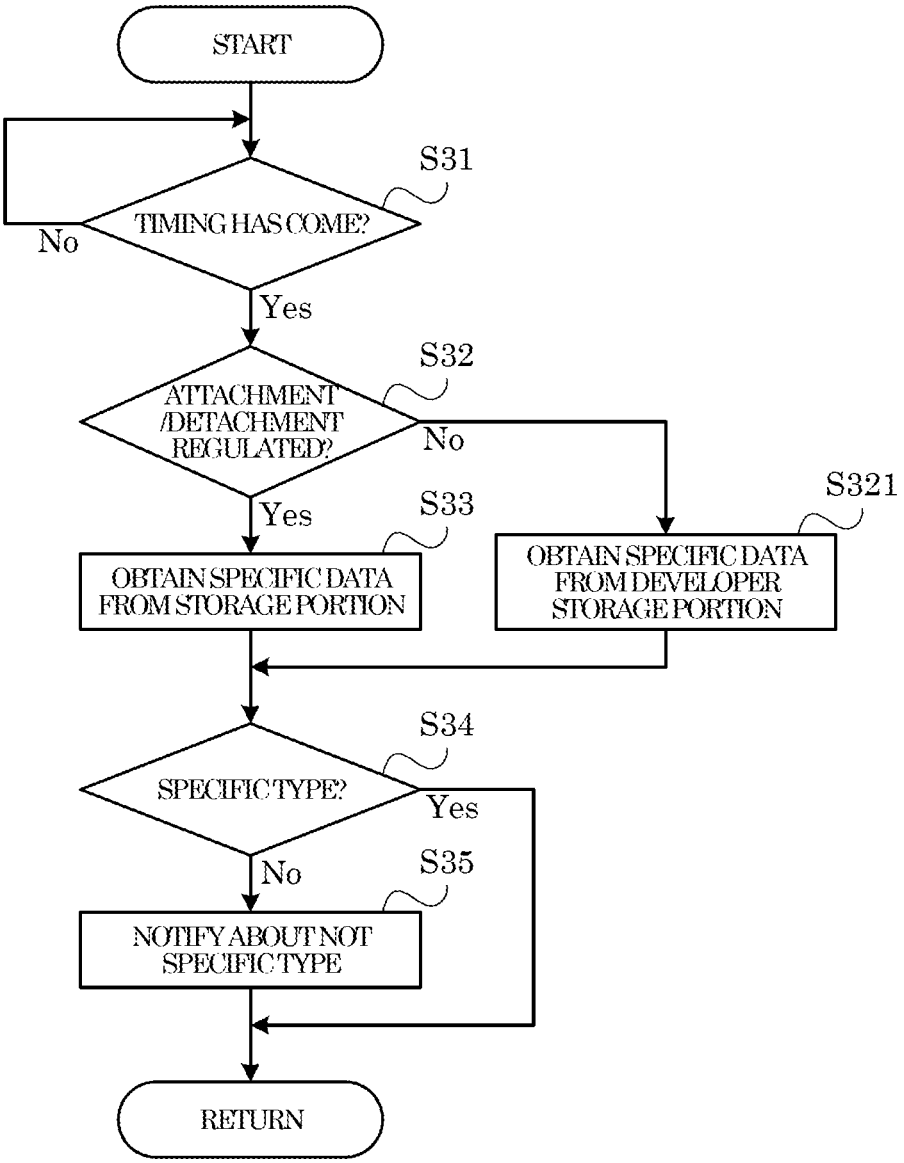
FIG. 7 is a flowchart showing an example of a type determination process executed by the image forming apparatus according to the embodiment of the present disclosure.

Next, in the following, with reference to FIG. 7, a description is given of an example of the procedure of the type determination process executed by the control portion 5 in the image forming apparatus 10.

<Step S31>

First, in step S31, the control portion 5 determines whether or not the predetermined timing has come.

Here, upon determining that the predetermined timing has come (Yes side at S31). the control portion 5 moves the process to step S32. On the other hand, upon determining that the predetermined timing has not come (No side at S31). the control portion 5 waits at step S31 for the predetermined timing to come.

<Step S32>

In step S32, the control portion 5 determines whether or not attachment/detachment of the toner container 316 is regulated by the lock mechanism 318. For example, the control portion 5 determines whether or not attachment/detachment of the toner container 316 is regulated by the lock mechanism 318, by using the second sensor.

Here, upon determining that the attachment/detachment of the toner container 316 is regulated by the lock mechanism 318 (Yes side at S32). the control portion 5 moves the process to step S33. On the other hand, upon determining that the attachment/detachment of the toner container 316 is not regulated by the lock mechanism 318 (No side at S32). the control portion 5 moves the process to step S321.

<Step S321>

In step S321, the control portion 5 obtains the specific data from the toner container 316. Specifically, the control portion 5 causes the data obtaining portion 317C to obtain the specific data from the IC tag of the toner container 316.

<Step S33>

In step S33, the control portion 5 obtains the specific data from the specific storage area of the EEPROM.

<Step S34>

In step S34, the control portion 5 determines whether or not the toner container 316 attached to the attachment portion 317 is a toner container of the specific type. Here, the processes of steps S31 to S34 are executed by the first determination processing portion 56 of the control portion 5.

Here, upon determining that the toner container 316 attached to the attachment portion 317 is a toner container of the specific type (Yes side at S34), the control portion 5 moves the process to step S31. On the other hand, upon determining that the toner container 316 attached to the attachment portion 317 is not a toner container of the specific type (No side at S34), the control portion 5 moves the process to step S35.

Here, in the image forming apparatus 10, when the attachment/detachment of the toner container 316 is regulated by the regulation processing portion 58, the specific data obtained from the toner container 316 by the data obtaining portion 317C is stored in the specific storage area of the EEPROM (step S25 of the attachment/detachment regulation process). In addition, in the type determination process, it is determined whether or not the toner container 316 attached to the attachment portion 317 is a toner container of the specific type, based on the specific data obtained from the specific storage area of the EEPROM.

As a result, while the attachment/detachment of the toner container 316 is regulated by the lock mechanism 318, it is possible to obtain the specific data regarding the toner container 316 attached to the attachment portion 317 even when either or both of the attachment portion 317 and the IC tag of the toner container 316 are failed. Thus, an erroneous notification is restricted even when either or both of the attachment portion 317 and the IC tag of the toner container 316 are failed.

<Step S35>

In step S35, the control portion 5 notifies that the toner container 316 attached to the attachment portion 317 is not a toner container of the specific type. For example, the control portion 5 displays, on the operation/display portion 6, a message indicating that the toner container 316 attached to the attachment portion 317 is not a toner container of the specific type. This urges replacement of the toner container 316 attached to the attachment portion 317 with a toner container of the specific type. Here, the process of step S35 is executed by the notification processing portion 52 of the control portion 5.

As described above, in the image forming apparatus 10, only in a case where the toner container 316 attached to the attachment portion 317 is determined to be a toner container of the specific type, the attachment/detachment of the toner container 316 is regulated by the lock mechanism 318. This makes it possible to reduce the remaining amount of toner in the toner container 316 at the time of replacement, and avoid the attachment/detachment of the toner container 316 storing toner that does not match its associated image forming apparatus, from being regulated.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an attachment portion to which a developer storage portion storing developer is attached;

a lock mechanism configured to regulate attachment and detachment of the developer storage portion attached to the attachment portion;

an image forming portion configured to execute a print process by using the developer;

a detection processing portion configured to detect whether or not the developer storage portion attached to the attachment portion is in a specific state in which a remaining amount of developer is smaller than a predetermined reference amount;

a release processing portion configured to, when the detection processing portion has detected that the developer storage portion is in the specific state, cause the lock mechanism to release a regulation on attachment and detachment of the developer storage portion;

a first determination processing portion configured to determine whether or not the developer storage portion attached to the attachment portion is a developer storage portion of a predetermined specific type; and a regulation processing portion configured to, when the first determination processing portion has determined that the developer storage portion attached to the attachment portion is a developer storage portion of the specific type, cause the lock mechanism to regulate attachment and detachment of the developer storage portion.

2. The image forming apparatus according to claim 1, further comprising:

a second determination processing portion configured to determine whether or not a developer storage portion is attached to the attachment portion; and a notification processing portion configured to, in a case where the second determination processing portion has determined that a developer storage portion is attached to the attachment portion, and further the first determination processing portion has determined that the developer storage portion attached to the attachment portion is not a developer storage portion of the specific type, notify thereabout.

3. The image forming apparatus according to claim 1, further comprising:

a data obtaining portion configured to obtain, from the developer storage portion attached to the attachment portion, specific data regarding the developer storage portion; and a storage processing portion configured to, when attachment and detachment of the developer storage portion is regulated by the regulation processing portion, store the specific data obtained from the developer storage portion by the data obtaining portion, into a storage portion, wherein when attachment and detachment of the developer storage portion is being regulated by the lock mechanism, the first determination processing portion determines whether or not the developer storage portion is a developer storage portion of the specific type based on the specific data stored in the storage portion by the storage processing portion, and when attachment and detachment of the developer storage portion is not being regulated by the lock mechanism, the first determination processing portion causes the data obtaining portion to obtain the specific data, and determines whether or not the developer storage portion is a developer storage portion of the specific type based on the obtained specific data.

4. A method for regulating attachment and detachment of a developer storage portion, the method being implemented in an image forming apparatus that includes: an attachment portion to which a developer storage portion storing developer is attached; a lock mechanism configured to regulate attachment and detachment of the developer storage portion attached to the attachment portion; and an image forming portion configured to execute a print process by using the developer, the method comprising:

a first step of detecting whether or not the developer storage portion attached to the attachment portion is in a specific state in which a remaining amount of developer is smaller than a predetermined reference amount;

a second step of, when the first step has detected that the developer storage portion is in the specific state, causing the lock mechanism to release a regulation on attachment and detachment of the developer storage portion;

a third step of determining whether or not the developer storage portion attached to the attachment portion is a developer storage portion of a predetermined specific type; and a fourth step of, when the third step has determined that the developer storage portion attached to the attachment portion is a developer storage portion of the specific type, causing the lock mechanism to regulate attachment and detachment of the developer storage portion.

* * * * *